US008613117B2

(12) United States Patent
Collins

(10) Patent No.: US 8,613,117 B2
(45) Date of Patent: Dec. 24, 2013

(54) SANITATION

(76) Inventor: Lisa Collins, Manchester (GB)

( * ) Notice: Subject to any disclaimer, the term of this patent is extended or adjusted under 35 U.S.C. 154(b) by 876 days.

(21) Appl. No.: 12/681,387

(22) PCT Filed: Oct. 3, 2008

(86) PCT No.: PCT/GB2008/003343

§ 371 (c)(1),
(2), (4) Date: Apr. 27, 2010

(87) PCT Pub. No.: WO2009/044145

PCT Pub. Date: Apr. 9, 2009

(65) Prior Publication Data

US 2010/0212081 A1 Aug. 26, 2010

(30) Foreign Application Priority Data

Oct. 5, 2007 (GB) ..... 0719587.8
Dec. 31, 2007 (GB) ..... 0725346.1

(51) Int. Cl.
*A47K 1/06* (2006.01)

(52) U.S. Cl.
USPC ..... 4/665

(58) Field of Classification Search
USPC ..... 4/665, 661
See application file for complete search history.

(56) References Cited

U.S. PATENT DOCUMENTS 4,101,986 A * 7/1978 Ng et al. ..... 4/325
5,251,346 A * 10/1993 Donati ..... 4/665

FOREIGN PATENT DOCUMENTS

| | | | |
|---|---|---|---|
| AT | 321828 | | 4/1975 |
| DE | 321828 | B * | 4/1975 |
| DE | 10304316 | | 8/2004 |
| DK | 10304316 | A1 * | 8/2004 |
| FR | 2788800 | | 7/2000 |
| FR | 2788800 | A * | 7/2000 |
| WO | WO 97/28320 | | 8/1997 |

OTHER PUBLICATIONS

International Search Report: Application No. PCT/GB2008/003343, EPO Jan. 23, 2009.

* cited by examiner

*Primary Examiner* — Lori Baker
(74) *Attorney, Agent, or Firm* — Schmeiser, Olsen & Watts LLP; Lowell W. Gresham; Charlene R. Jacobsen

(57) ABSTRACT

There are provided sanitary assemblies (101) comprising a toilet cistern (103) and conveying means, including a pump (107), for conveying waste water into said cistern (103) from an article of sanitary ware such that said waste water can be re-used. Also provided are toilet assemblies comprising such sanitary assemblies and methods for their use.

24 Claims, 2 Drawing Sheets

SANITATION

FIELD OF INVENTION

The present invention relates to sanitation, particularly, though not exclusively, to the re-use of waste water.

BACKGROUND TO THE INVENTION

It is increasingly recognised that water is an important resource that should be used sparingly. However, large quantities of water are still wasted. For example, in a domestic residence used bath water is classed as "waste water" and discharged to sewer even though it may only be lightly soiled.

Accordingly, the present invention aims to address at least one disadvantage associated with the prior art whether discussed herein or otherwise.

SUMMARY OF THE INVENTION

According to a first aspect of the present invention there is provided a sanitary assembly comprising a toilet cistern and conveying means, including a pump, for conveying waste water into said cistern from an article of sanitary ware such that said waste water can be re-used.

Suitably, the sanitary assembly can be used to replace a known cistern of a toilet assembly comprising a cistern and toilet bowl.

Suitably, the sanitary assembly comprises a single cistern, i.e. only one cistern.

Suitably, the sanitary assembly comprises a single cistern and wherein the cistern comprises an outlet at the lower, in use, end thereof and which is arranged to receive an outlet valve means which compromises a weighted plug/plunger having a conical portion arranged to enter and seal said outlet.

Suitably, the sanitary assembly is arranged to re-use waste water from a bath. Suitably, the sanitary assembly is arranged to re-use water from a bath without need to modify the bath. The sanitary assembly may be able to re-use water from other articles of sanitary ware, for example a hand basin.

Suitably, the conveying means of the sanitary assembly comprises a conduit for locating into waste water contained by an article of sanitary ware. Suitably, the conduit comprises a hose which may comprise an extendible hose. The conveying means may thus not require a plumbed connection to the article of sanitary ware from which waste water is to be conveyed.

Suitably, the conduit comprises filter means preferably located at the inlet thereof. The filter means may comprise of a mesh screen and may be arranged to restrict objects, for example debris, entering the assembly. The filter means may comprise a cover, for example a cap, which may fit, for example screw, onto the end of the conduit. The filter means may comprise a mesh, suitably a cloth mesh. The conduit may comprise a wide mouth opening and the filter means may comprise a detachable cloth mesh cover for the opening.

Suitably, the conveying means of the sanitary assembly comprises a hand operated pump. Suitably the assembly comprises a casing housing a cistern. Suitably, the pump is housed within a cistern casing. Suitably, the pump comprises a vessel having a chamber arranged to expand between discharge and charge configurations.

Suitably, the pump is actuated by a pump lever coupled to the pump. The assembly may comprise means to minimise the pumping force required by a user. Suitably, the pump lever is coupled to the pump by a mechanism which lessens the pumping force required by a user. Said mechanism which lessens the pumping force required by a user may for example comprise a pulley system. Alternatively, the assembly may comprise a pump lever directly connected to a pump and the pump lever may be long so as to reduce the force required to operate the pump. The pump lever may have a length of one meter. The pump lever may be detachable.

Suitably, the conveying means comprises a valve, suitably a non-return valve. The conveying means may comprise a diverter valve. The conveying means may comprise an incoming non return valve. The conveying means may comprises an incoming non-return valve and an outgoing non-return valve. Suitably, the pump comprises an incoming non return valve.

The assembly may comprise a drain means which may form part of the conveying means. Suitably, the drain means is arranged such that it can direct water upstream of the pump into a water receptacle, suitably into a toilet bowl. The drain means is suitably arranged to allow water left in the conveying means to be emptied from the conveying means once a user has finished transferring water to the cistern.

Suitably, the drain means comprises a drain conduit, suitably tube, in communication with the pump via a valve, suitably a diverter valve. Suitably, the pump is in communication with an inlet of the conveying means via a valve, suitably a diverter valve. Suitably, the assembly comprises a diverter valve which determines whether a conduit leading to a pump is in fluid communication with a drain means or an inlet of the conveying means.

The assembly is suitably arranged such that a user can determine the position of a valve, suitably diverter valve, of the drain means. Suitably the valve is controlled by a flush control means, suitably a flush handle, which also controls the position of a flush valve which is suitably an outlet valve of the cistern.

Suitably, the cistern is arranged to contain sufficient water for one or more flushes of a toilet, preferably two or more, more preferably three or more. The cistern may be arranged to contain water for four or more flushes, for example for: five; six; seven; eight; nine; or ten or more flushes, for example ten, eleven or twelve or more flushes. Suitably, one flush comprises between five and ten liters, for example around six liters.

Suitably, the assembly is arranged such that the cistern can be charged with sufficient waste water for one or more flushes of a toilet, preferably two or more, more preferably three or more. The cistern may be arranged to contain water for four or more flushes, for example for: five; six; seven; eight; nine; or ten or more flushes, for example ten, eleven or twelve or more flushes.

Suitably, the assembly comprises fill control means to cause the cistern to be charged with water should the quantity of water in the cistern fall below a predetermined minimum.

Suitably, said predetermined minimum comprises an amount corresponding to one flush of a toilet. Suitably, said minimum comprises between five and ten liters.

Suitably, the fill control means comprises a water level detector. Suitably, the water level detector comprises a float. Suitably, the float is coupled to an inlet valve.

Suitably, the cistern comprises a first inlet in communication with the conveying means. The cistern suitably further comprises a second inlet for connection to an alternate water supply. Suitably, said alternate water supply comprises a fresh water supply, suitably a mains water supply.

Suitably, the second inlet comprises an inlet valve controlled by the fill control means. Suitably the inlet valve is coupled to the float of the fill control means.

Suitably, the fill control means is arranged, in use, to cause the cistern to be charged with water via said second inlet should the quantity of water in the cistern fall below a predetermined minimum.

Suitably, the fill control means is arranged to cause the cistern to be charged with fresh water. Suitably, said water is supplied from said alternate water supply.

Suitably, in use, the cistern can be charged with waste water from an article of sanitary ware sufficient for a plurality of flushes of a toilet. If that charge of water falls below the amount required for one flush then the fill control means may cause the cistern to be filled from the alternate water supply. The alternate water supply may continue to keep the cistern charged with water for one toilet flush until such time as a new charge of waste water is provided into the cistern. Operation of the toilet may thus always be possible.

Suitably, the cistern comprises an outlet located at the lower, in use, end thereof which is suitably arranged to be plumbed to a toilet bowl. Suitably, the cistern comprises a tank having an aperture in the lower, in use, end thereof. Suitably, said aperture provides the cistern outlet.

Suitably, the outlet is arranged to receive an outlet valve means. Suitably, the outlet valve means comprises a weighted plug. Suitably, the plug is in communication with flush control means. The plug may be coupled to a flush handle via a pulley system to reduce the flushing force which a user must exert.

Suitably, the plug comprises a conical portion arranged to enter and seal the tank aperture. Suitably, the conical portion comprises a narrow cone. Suitably the wall of the cone is angled at around 30 degrees or less to the vertical axis. Suitably, the conical portion is provided at a lowermost tip of the plunger and the remainder of the plunger is substantially cylindrical, preferably with circular cross section.

Suitably, the plug comprises a rubber surface for sealing the aperture. Suitably, the surface of the conical portion comprises a rubber surface for sealing the aperture.

Suitably, the plunger is configured such that it is never fully submerged. Accordingly, the plunger may not be subjected to a varying weight of water pressing down on it. The weight of the plunger may thus allow a consistent force to act on the flush handle despite a varying water level and may allow for consistent control of water flow.

Suitably, the assembly comprises guide means for guiding the travel of the weighted plug. The guide means may comprise guide braces which may be secured to the tank, for example welded to the tank inner surface.

Alternatively, the cistern may comprise a tank having an aperture in the lower, in use end thereof and an outlet unit located in said aperture. Suitably, the outlet unit comprises an outlet valve in communication with flush control means. Suitably, the outlet unit can locate into the tank from the outside thereof which may facilitate convenient assembly of the cistern. The tank skin may form a spigot for connection of the outlet valve. The tank may have a smooth internal surface which may be shaped to minimise water residues left in the tank and the outlet unit may form a continuation of this smooth surface to the exit orifice.

Suitably, the flush control means comprises a flush handle. Suitably, the cistern comprises an outlet valve which is only open when the flush control means, suitably the flush handle, is in an open position. Thus the amount of water used for a flush may be limited by a user so that water may be conserved. Suitably, the flush handle is arranged to open and close a flush valve which suitably comprises the cistern outlet valve. The flush handle may be arranged to open and close a pump drain valve.

Suitably, the assembly comprises indicator means to indicate the water level in the cistern. The indicator means may be such that it allows a user to make a visual inspection of the water level in the cistern.

Suitably, the cistern comprises an overflow means to allow water to be released from the cistern in case of overfilling. Suitably, the overflow comprises indicator means of the assembly. Suitably, the overflow can facilitate visual inspection of the cistern water level. The overflow suitably comprises an up-flow pipe and a down-flow pipe. The tank skin may form a spigot for connection of the outlet valve. The indicator means may indicate the water level in the up-flow pipe. The up-flow pipe may be made of suitable material, for example transparent plastics, so that the water level inside the up-flow pipe can be easily observed. The water level may be communicated to a user by an opening in a casing of the assembly. Suitably the overflow pipe can locate into the tank from the outside thereof which may facilitate convenient assembly of the cistern.

The indicator means may comprise a pressure gauge, for example a digital display pressure gauge or hydraulic pressure gauge or a visual float to convey to a user the volume of water in the tank. The indicator means may comprise float, for example a weighted float or vacuum trapped float in the up tube of the overflow, connected to information means which can provide information concerning the water level to a user. Suitably, the information means comprises a wheel marked on the side with volume markers, for example markers for 1 flush, 2 flushes etc. Suitably the information means is arranged such that the wheel turns as the float rises and falls. To achieve this the float may be connected to a counter weight or spring or the wheel may be biased, for example by a spring, suitably a spiral spring. Suitably, the wheel is visible through an opening in a casing of the assembly and there may be a marker such as an external arrow to point to the relevant part of the wheel.

Suitably, in use, the waste water which is pumped into the assembly comprises water substantially free of harmful substances. The waste water may comprise lightly soiled water. If the waste water is considered heavily soiled or has had something hazardous spilt in it a user may simply discharge it without pumping it into the cistern. The cistern may then be refilled on the next occasion. Should it run down to one flush before being recharged with waste water it may be refilled from an alternative supply until it is next charged with waste water. A user may occasionally wash the assembly by using the conduit to transfer fresh or preferably chemically treated water into the cistern, for example from an article of sanitary ware into the cistern.

According to a second aspect of the present invention there is provided a toilet assembly comprising a toilet bowl and a sanitary assembly according to the first aspect with a cistern of said sanitary assembly plumbed to said toilet bowl.

According to a third aspect of the present invention there is provided a method of re-using water, the method comprising using an assembly according to the first and/or second aspect, wherein the method comprises pumping waste water held by an article of sanitary apparatus into a cistern of said assembly and subsequently actuating a flush to release water from the cistern into a toilet bowl.

The method may comprise any feature as described in relation to the first aspect.

BRIEF DESCRIPTION OF THE DRAWINGS

Preferred embodiments of the present invention will now be illustrated by way of example with reference to the accompanying drawings in which.

DETAILED DESCRIPTION OF PREFERRED EMBODIMENTS

Figure 1:
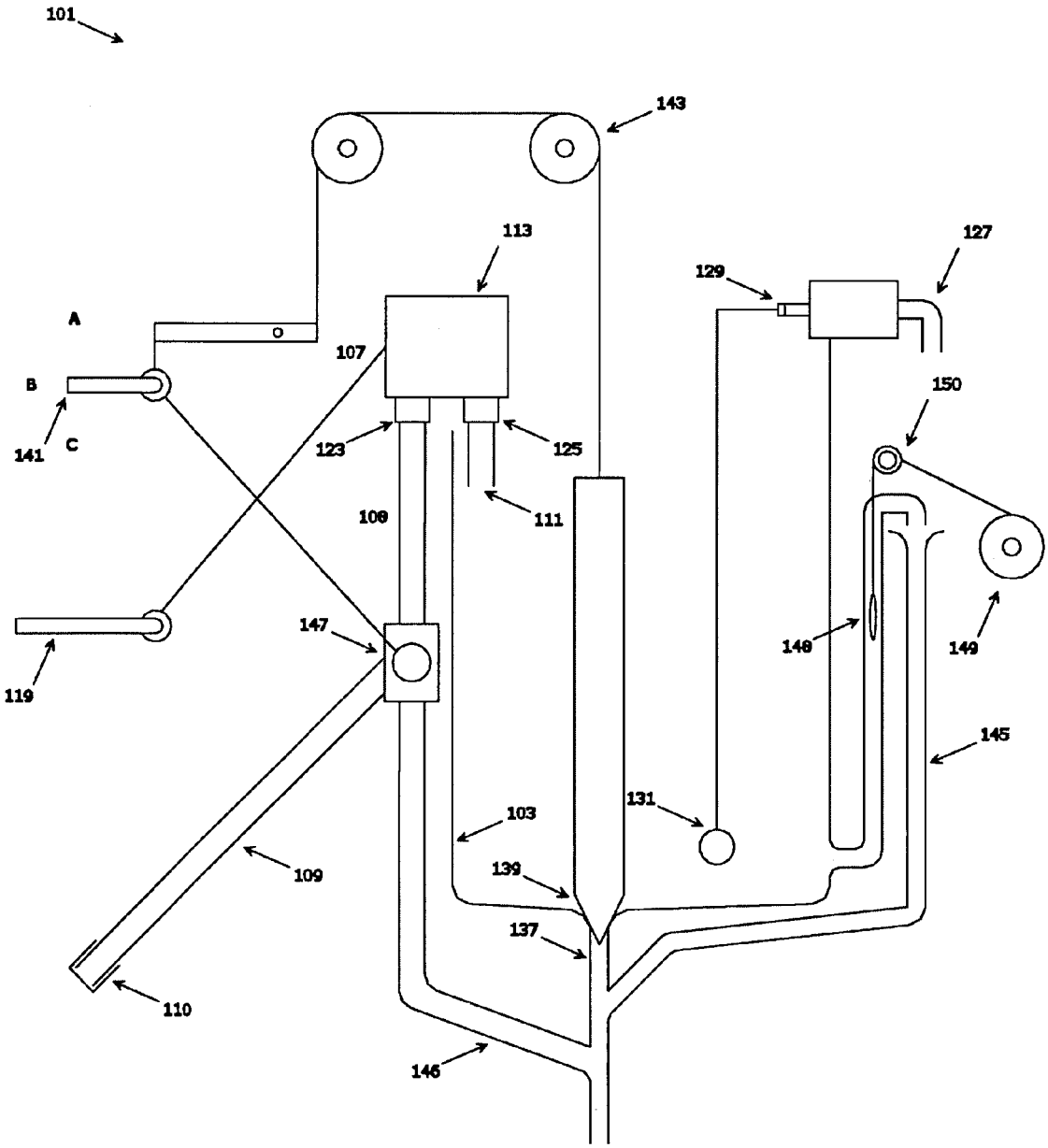
FIG. 1 is a schematic showing the components of a first embodiment of a sanitary assembly.

As illustrated by FIG. 1 a sanitary assembly 1 comprises a cistern 3 located in a cistern housing (not shown) with conveying means comprising a pump 7 and a conduit comprising an extendible hose 9 in communication therewith. The conveying means comprises an inlet (first inlet) 11 to the cistern 3.

The pump comprises a vessel having a chamber whose volume alters between charge and discharge configurations. The assembly comprises a pump handle (lever) coupled to the pump. Rotation of the handle causes the chamber of the pump to move to a charge configuration.

The conveying means also comprises non return valves, located on either side of the pump.

The assembly further comprises a second inlet to the cistern and which is in communication with a mains water supply in the illustrated embodiment but which may be in communication with an alternative supply, such as a rainwater tank plus mains top up and pressured pumping system, in other embodiments. The inlet is controlled by fill control means comprising a valve coupled to a float which causes the valve to open when the water level within the cistern falls below that of six liters (enough for one flush) and to close when it rises above that level.

The cistern comprises a tank having an aperture into which an outlet unit is located. The outlet unit comprise an outlet to the cistern which is sealed by a ball and spring valve which is coupled to a flush means comprising a flush handle by a pulley system. Rotation of handle causes the valve to open. In use the outlet is plumbed to a toilet bowl (not shown in fig.)

The ball and spring valve are smaller in diameter than the aperture at the base of the tank and fitted with a single connection with the male connector being an integral part of the tank base spigot. Thus the valve unit can be fitted in the tank base from the outside without the need for internal tightening.

The assembly 1 also comprises an overflow arranged to allow water to be discharged from the cistern if it is overfilled. The cistern is arranged to hold water for twelve average flushes (around 70 liters.) The overflow is fitted with a single connection, with the male connector being an integral part of the tank side spigot. Thus the overflow can be fitted in the tank side from the outside without the need for internal tightening. The overflow comprises of an up-flow and a down-flow pipe. The up-flow pipe is made of such a material so that the water level inside the up-flow pipe can be easily inspected.

Figure 2:
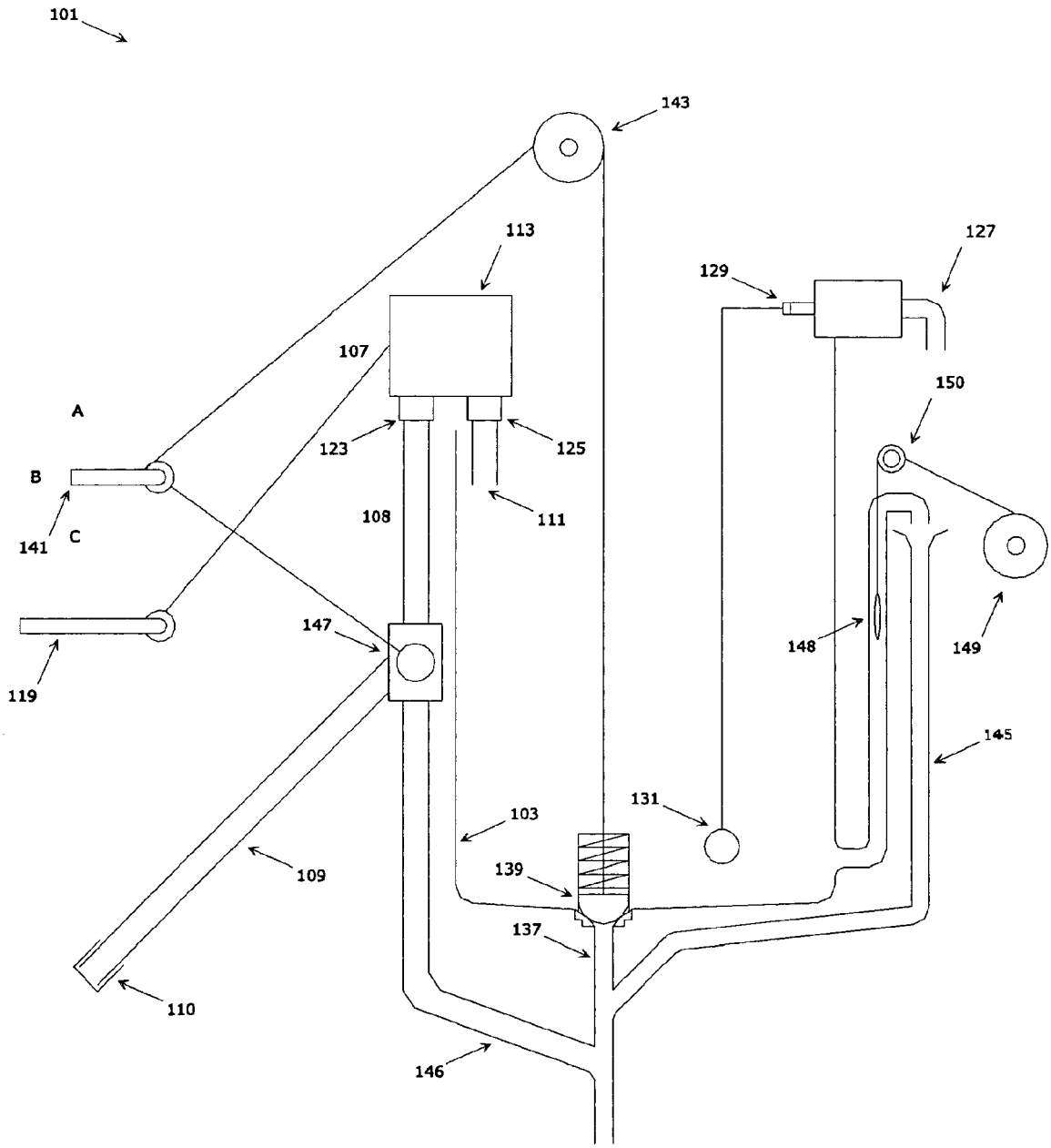
FIG. 2 is a schematic showing the components of a second embodiment of a sanitary assembly.

FIG. 1 illustrates an embodiment of a sanitary assembly 101 which comprises a cistern 103 located in a cistern housing (not shown) with conveying means comprising a pump 107 and a conduit 108 comprising an extendible house 109 in communication therewith. The embodiment of FIG. 2 is generally the same as that of FIG. 1 but differs in that it further comprises a drain tube 146 and valve 147, an indicator means comprising a float 148 and information means comprising a wheel 149.

The conveying means comprises an inlet (first inlet) 111 to the cistern 103 and the pump 107 comprises a vessel 113 having a chamber whose volume alters between charge and discharge configurations. The assembly 101 comprises a pump handle (lever) 119 coupled to the pump 107. The pump handle 119 comprises a removable long handle. Rotation of the handle 119 causes the chamber volume of the pump 107 to alter. The conveying means also comprises a flap type non-return valve and a flap type non-return valve 125 located downstream of the pump 107. Fitted to the end of hose 109 is a cloth mesh filter 110.

The cistern 103 comprises a tank 133 for holding around 72 liters (12 flushes) of water and the assembly 101 further comprises an outlet unit 135 comprising a valve 139 fitted at an outlet 137 of the cistern 103. Operation of valve 139 is controlled by a flush handle 141 via a pulley 143.

To ensure there is always water for one flush the assembly 101 includes a second inlet 127 to the cistern 103 in communication with an alternate water supply and controlled by a valve 129 depending on the level of weighted float 131. If the cistern is overfilled it may empty via overflow 145.

In the embodiment of FIG. 1, the assembly 101 also comprises a drain tube 146 connected to the conduit 108, upstream of the chamber of the pump 107 and terminating at the cistern outlet. A drain valve 147 is located at a junction between the hose 109, remainder of the conduit 108 and the drain tube 146. The drain tube 146 is shut off by the drain valve 147 during pump operation and the drain valve is opened after pump operation to allow any water held in the chamber of the pump 107 to drain away. The drain valve 147 is coupled to a flush handle 141 to allow drain valve 147 to be operated by the flush handle 141 directly. In the illustrated embodiment the flush handle 141 is configured in such manner that the drain valve 147 is closed when the handle 141 is in an up position (designated A) and open when the handle 141 is in a horizontal position (designated B). In the horizontal handle position the flush valve 139 is also closed. When the handle 141 is moved to a down position (designated C) the flush valve 139 is opened, the drain valve 147 also remains open from the horizontal (designated B) to the down position (designated C).

In the embodiment of FIG. 1, rather than having an overflow pipe in which the water level can be inspected a float is located in the overflow pipe 145 and is in communication with information means. The information means comprises a wheel 149 having a dial face provided with water level indica. In the illustrated embodiment the wheel 149 is spiral sprung to ensure it rotates both as the float rises and falls and is connected to the float via pulley wheel 150. A viewing window is provided in the cistern housing (not shown) to allow the dial face to indicate the water level to a user.

In use assembly 101 is plumbed to toilet bowl such that the outlet 137 is in communication therewith. A user uses a bath (or other article of sanitary ware such as a shower) normally and then transfers waste water from the bath (or other article) to the cistern 103.

To use the assembly 101 of FIG. 1 a user transfers water by locating the hose 109 such that the end lies within the water. The user then actuates the hand pump to draw water into the hose 109 and pump it into the cistern 103. The pump is actuated by handle 119 and causes water to be discharged from the pump into the cistern 103. The user may pump until the cistern 103 is full or the article from which waste water is being transferred is empty. Should the cistern 103 be overfilled water can exit via the overflow 145.

To flush the toilet a user turns the flush handle 141 a quarter turn and holds it in that position until the desired quantity of water for the flush is released. A "normal" flush is six liters but less may be used in many cases.

The cistern holds around 70 liters, enough for twelve "normal" flushes and it is therefore likely it can be re-charged with waste water before the water level falls below that needed for one flush. However, should the water level fall below six liters the float 131 will drop causing the valve 129 of the second inlet 127 to open allowing the cistern 103 to be charged up to the six liter level with mains water. Once the float rises to the six liter level the valve closes again. Thus the cistern may be kept charged with sufficient water for one flush in this manner until recharged with waste water via the hose 109 and pump 107.

The hose has a mesh filter at the end to prevent debris entering the cistern but the user may also exercise judgment before transferring water. For example, if the water is heavily soiled or if something hazardous is spilt in it a user may choose to discharge it normally rather than transfer it to the cistern. The user can also clean the cistern out occasionally by filling it with clean or preferably chemically treated water via the hose.

In use, the user turns the flush handle 141 to a pump ready position (position A), closing the drain valve 147. The user transfers water by locating the hose 109 such that the end lies within the water. The user then actuates the hand pump with handle 119 to draw water into the hose 109 and pump it into the cistern 103.

When the user is finished filling the cistern or the article from which waste water is being transferred, for example a bath, is empty the user turns the flush handle 141 to a pump finished position (position B), opening the drain valve 147. This allows water from the conduit above valve 147 to drain into the toilet bowl. This may also release an air lock allowing water to drain from the hose 109 back into the bath and so may avoid water being spilt when the hose is removed from the bath. The flush handle 141 can also be moved to the pump ready position (position A) with the hose 109 removed from a water supply and the pump handle 119 moved to draw air into the pump chamber and expel water from the chamber and into the cistern tank.

To flush the toilet a user turns the flush handle 141 no more than a quarter turn (position C) and holds it in that position until the desired quantity of water for the flush is released.

FIG. 2 illustrates an alternative embodiment which is substantially the same as that of FIG. 1 and like parts are labelled accordingly. The distinction is that the outlet unit is replaced with a simple aperture in the base of the tank which provides the cistern outlet and this is sealed by a weighted plug 139.

The plug 139 comprises a cylinder having a rubber surface cone at the base thereof arranged to enter and seal the aperture. The plug is arranged to extend above the level of the water in the tank such that it is never fully submerged. Accordingly, it is not subjected to a varying weight of water and exerts a consistent force on the flush handle to which it is coupled via a pulley system. This may allow for good control of the flow of water exiting via the aperture when the flush handle is moved to withdraw the plug from the aperture and release the seal.

It will be appreciated that preferred embodiments of the present invention may beneficially provide for the convenient recycling of water.

It is to be understood that the invention is not restricted to the details of the foregoing embodiment(s). The invention extends to any novel one, or any novel combination, of the features disclosed.

The invention claimed is:

1. A sanitary assembly comprising:

a toilet cistern;

a conveyor for conveying waste water into said toilet cistern from an article of sanitary ware such that said waste water can be re-used, wherein the conveyor includes a pump;

a fill controller for causing the toilet cistern to be charged with water should the quantity of water in the toilet cistern fall below a predetermined minimum; and wherein the toilet cistern comprises a first inlet in communication with the conveyor and a second inlet for connection to an alternate water supply, the second inlet including an inlet valve controlled by the fill controller.

2. A sanitary assembly according to claim 1, wherein the assembly comprises a single cistern and wherein the cistern comprises an outlet at the lower, in use, end thereof and which is arranged to receive an outlet valve which comprises a weighted plug/plunger having a conical portion arranged to enter and seal said outlet.

3. A sanitary assembly according to claim 1, wherein the conveyor of the sanitary assembly comprises a conduit for conveying the waste water contained by the article of sanitary ware.

4. A sanitary assembly according to claim 3, wherein the conduit comprises a hose and the conveyor does not require a plumbed connection to the article of sanitary ware from which waste water is to be conveyed.

5. A sanitary assembly according to claim 3, wherein the conduit comprises a filter for filtering the waste water.

6. A sanitary assembly according to claim 1, wherein the pump is selected from the group comprising a hand operated pump, a mechanically operated pump, an electrically operated pump, an impeller pump and a diaphragm pump.

7. A sanitary assembly according to claim 1, wherein the pump comprises a vessel having a chamber arranged to expand between discharge and charge configurations and a resiliently deformable member which biases the chamber towards one of said configurations.

8. A sanitary assembly according to claim 1, wherein the pump is actuated by a pump lever coupled to the pump by a mechanism which lessens the pumping force required by a user.

9. A sanitary assembly according to claim 1, wherein the conveyor comprises a valve.

10. A sanitary assembly according to claim 1, wherein the assembly comprises a drain arranged to allow water left in the conveyor to be emptied from the conveyor once a user has finished transferring water to the cistern.

11. A sanitary assembly according to claim 1, wherein the assembly comprises a drain for draining waste water, wherein the drain comprises a drain conduit in communication with the pump via a valve.

12. A sanitary assembly according to claim 1, wherein the assembly comprises a diverter valve which determines whether a conduit leading to the pump is in fluid communication with a drain or an inlet of the conveyor.

13. A sanitary assembly according to claim 1, wherein, in use, the cistern can be charged with waste water from an article of sanitary ware sufficient for a plurality of flushes of a toilet and if that charge of water falls below the amount required for one flush then the fill controller causes the cistern to be charged with water from the alternate water supply.

14. A sanitary assembly according to claim 1, wherein the cistern comprises a tank having an aperture in a lower, in use, end thereof and a weighted plug arranged to seal the aperture.

15. A sanitary assembly according to claim 14, wherein the tank comprises a smooth internal surface which is shaped to minimise water residues left in the tank and the outlet forms a continuation of this smooth surface to the aperture.

16. A sanitary assembly according to claim 15, wherein the surface curves to a substantially vertical aspect adjacent the outlet.

17. A sanitary assembly according to claim 1, wherein the assembly comprises a flush controller for controlling the flushing of waste water, the flush controller comprising a flush handle.

18. A sanitary assembly according to claim 17, wherein said flush handle further controls the position of a diverter valve.

19. A sanitary assembly according to claim 1, wherein the assembly comprises an indicator adapted to indicate the water level in the cistern.

20. A sanitary assembly according to claim 19, wherein the indicator comprises a float connected to an information element which can provide information concerning the water level to a user.

21. An assembly according to claim 20, wherein the information element comprises a wheel marked on the side with volume markers.

22. A sanitary assembly according to claim 1, wherein the cistern comprises an overflow element for allowing water to be released from the cistern in case of overfilling and wherein the overflow element comprises an indicator of the assembly for indicating a water level in the cistern.

23. A toilet assembly comprising:

a sanitary assembly, said sanitary assembly including:

a toilet cistern;

a conveyor for conveying waste water into said toilet cistern from an article of sanitary ware such that said waste water can be re-used, wherein the conveyor includes a pump;

a fill controller for causing the toilet cistern to be charged with water should the quantity of water in the cistern fall below a predetermined minimum;

wherein the toilet cistern comprises a first inlet in communication with the conveyor and a second inlet for connection to an alternate water supply, the second inlet including an inlet valve controlled by the fill controller; and a toilet bowl, wherein said toilet cistern of said sanitary assembly is plumbed to said toilet bowl.

24. A method of re-using water comprising:

using a sanitary assembly that includes a toilet cistern and a conveyor for conveying waste water into said toilet cistern from an article of sanitary ware such that said waste water can be re-used, wherein the conveyor includes a pump, a fill controller for causing the toilet cistern to be charged with water should the quantity of water in the toilet cistern fall below a predetermined minimum, and wherein the toilet cistern includes a first inlet in communication with the conveyor and a second inlet for connection to an alternate water supply, the second inlet including an inlet valve controlled by the fill controller;

pumping waste water held by the article of sanitary ware into the toilet cistern of said assembly; and actuating a flush to release water from the toilet cistern into a toilet bowl.

* * * * *